US006189326B1

(12) United States Patent
Tomatsu et al.

(10) Patent No.: US 6,189,326 B1
(45) Date of Patent: Feb. 20, 2001

(54) PRESSURE CONTROL VALVE

(75) Inventors: Yoshitaka Tomatsu, Chiryu; Sadatake Ise, Tokyo, both of (JP)

(73) Assignees: Denso Corporation, Kariya; Fujikoki Corporation, Tokyo, both of (JP)

( * ) Notice: Under 35 U.S.C. 154(b), the term of this patent shall be extended for 0 days.

(21) Appl. No.: 09/348,153

(22) Filed: Jul. 6, 1999

(30) Foreign Application Priority Data

Jul. 7, 1998 (JP) ..... 10-192069
Feb. 9, 1999 (JP) ..... 11-031776

(51) Int. Cl.[7] ..... F25B 41/04
(52) U.S. Cl. ..... 62/222
(58) Field of Search ..... 62/222, 513, 528

(56) References Cited

U.S. PATENT DOCUMENTS 3,638,446 2/1972 Palmer .
5,245,836 9/1993 Lorentzen et al. .
5,890,370 * 4/1999 Sakakibara et al. ..... 62/222
6,044,655 * 4/2000 Ozaki et al. ..... 62/513

FOREIGN PATENT DOCUMENTS 0 438 625-A2 7/1991 (EP) .
0 786 632-A2 7/1997 (EP) .
0 837 291-A2 4/1998 (EP) .

* cited by examiner

*Primary Examiner*—Corrine McDermott
*Assistant Examiner*—Mohammad M Ali
(74) *Attorney, Agent, or Firm*—Harness, Dickey & Pierce, PLC

(57) ABSTRACT

A temperature sensing portion of a control valve main body is located in a first refrigerant passage for communicating an outlet side of a radiator with an inlet side of an internal heat exchanger, and a second refrigerant passage for introducing the refrigerant flowing from the internal heat exchanger to an upstream side of a valve port in a refrigerant flow is formed in a casing main body. Accordingly, since it is possible to reduce a delay of temperature change in a sealed space (control chamber) with respect to refrigerant temperature change at the outlet side of the radiator, a temperature response characteristic of the pressure control valve is improved. Further, since it is not necessary to separately assemble a capillary tube, a temperature sensing cylinder or the like to the outlet side of the radiator, it is possible to reduce the number of processes for assembling the $CO_2$ cycle and to attempt to reduce a manufacturing prime cost.

6 Claims, 7 Drawing Sheets

PRESSURE CONTROL VALVE

CROSS REFERENCE TO RELATED APPLICATION

This application is based upon and claims priority from Japanese Patent Application Nos. Hei 10-192069, filed Jul. 7, 1998, and Hei 11-31776, filed Feb. 9, 1999, the entire contents of which are incorporated herein by reference.

BACKGROUND OF THE INVENTION

1. Field of the Invention

The present invention relates to a pressure control valve which controls a refrigerant pressure at an outlet side of a radiator based on a refrigerant temperature at the outlet side of the radiator, and it is preferably applicable to a vapor compression type refrigeration cycle in which carbon dioxide ($CO_2$) is used as a refrigerant.

2. Description of Related Art

Hitherto, there has been known means for attempting to improve a refrigeration performance by means of lowering enthalpy of the refrigerant at an inlet side of an evaporator by performing heat exchange between the refrigerant at an outlet side of the evaporator and that at the outlet side of the radiator.

Furthermore, as a control valve for adjusting a valve port based on the refrigerant temperature at the outlet side of the radiator, there has been known an invention disclosed in Japanese Patent Application Laid-Open No. Shou 55-54777.

According to the control valve disclosed in the above prior art, since a temperature sensing portion for sensing the refrigerant temperature at the outlet side of the radiator and the valve port whose opening degree is to be adjusted according to an internal pressure of the temperature sensing portion are provided in the same flow passage in series, there is a problem that the refrigeration performance cannot be improved by the aforementioned means.

In order to solve this problem, as disclosed in Japanese Patent Application Laid-Open No. Hei 5-203291, there is considered means in which the temperature sensing portion is made into a temperature sensing cylinder using a capillary tube to detect the refrigerant temperature at the outlet side of the radiator. However, in this means, since a heat sensed by the temperature sensing cylinder transmits to a control chamber at a diaphragm side through the capillary tube, the temperature change in the control chamber is lagged with respect to a refrigerant temperature change at the outlet side of the radiator. Therefore, by this means, a response characteristic of the control valve with respect to the refrigerant temperature change at the outlet side of the radiator (hereafter, this response characteristic is referred to as temperature response characteristic) is compromised, so that it is impossible to suitably control the refrigeration cycle.

Further, since it is necessary to assemble the capillary tube and the temperature sensing cylinder to the outlet side of the radiator, the manufacturing processes for the refrigeration cycle is increased.

SUMMARY OF THE INVENTION

The present invention is made in light of the above-mentioned problems, and it is an object of the present invention to provide a pressure control valve suitable for the refrigeration cycle having a heat exchanger for performing heat exchange between the refrigerant at the outlet side of the evaporator and that at the outlet side of the radiator.

According to a pressure control valve of the present invention, a temperature sensing portion is located in a casing for accommodating a control valve main body, and a temperature sensing chamber communicating with an inlet side of a heat exchanger and an introduction passage for introducing a refrigerant flowing from the heat exchanger to an upstream side of a valve port in a refrigerant flow are formed in the casing.

Accordingly, it is possible to reduce a lag of temperature change in the temperature sensing portion with respect to a refrigeration temperature change at an outlet side of a radiator in comparison with means for sensing a refrigerant temperature at the outlet side of the radiator by, as described in Japanese Patent Application Laid-Open No. 5-203291, making the temperature sensing portion into the temperature sensing cylinder using the capillary tube.

Therefore, since it is possible to improve the temperature response characteristic of a pressure control valve, the refrigeration cycle can be suitably controlled.

Further, since it is not necessary to assemble the capillary tube and the temperature sensing cylinder to the outlet side of the radiator like Japanese Patent Application Laid-Open No. 5-203291, it is possible to reduce the number of processes for assembling the refrigeration cycle (the number of manufacturing processes), so that it is possible to attempt to reduce a manufacturing prime cost of the refrigeration cycle.

As described above, by the pressure control valve according to the present invention, it is possible to suitably control the refrigeration cycle while attempting to reduce a manufacturing prime cost of the refrigeration cycle.

According to another aspect of the present invention, the pressure control valve includes: a casing in which there are formed a first passage for communicating an outlet side of a radiator with an inlet side of a heat exchanger, and a second passage for introducing a refrigerant flowing from the heat exchanger to an upstream side of a valve port in a refrigerant flow; a temperature sensing portion whose internal pressure changes according to a temperature of the refrigerant flowing through the first passage; and a valve body which penetrates through a separation portion for separating the first and second passages and adjusts an opening degree of the valve port by mechanically interlocking with an internal pressure change of the temperature sensing portion.

Accordingly, it is possible to suitably control the refrigeration cycle while attempting to reduce a manufacturing prime cost of the refrigeration cycle.

Further, according to another aspect of the present invention, the heat sensing portion is prevented from being cooled by providing heat insulating members for preventing a heat transfer between the temperature sensing portion and the second passage, so that it is possible to surely control the refrigerant pressure at the outlet side of the radiator.

Furthermore, according another aspect of the present invention, the heat sensing portion is prevented from being cooled by providing a passage for allowing a part of the refrigerant flowing through the first passage to flow to the second passage, so that it is possible to surely control the refrigerant pressure at the outlet side of the radiator.

BRIEF DESCRIPTION OF THE DRAWINGS

Other features and advantages of the present invention will be appreciated, as well as methods of operation and the function of the related parts, from a study of the following detailed description, the appended claims, and the drawings, all of which form a part of this application. In the drawings:

DETAILED DESCRIPTION OF PREFERRED EMBODIMENTS (First Embodiment)

Figure 1:
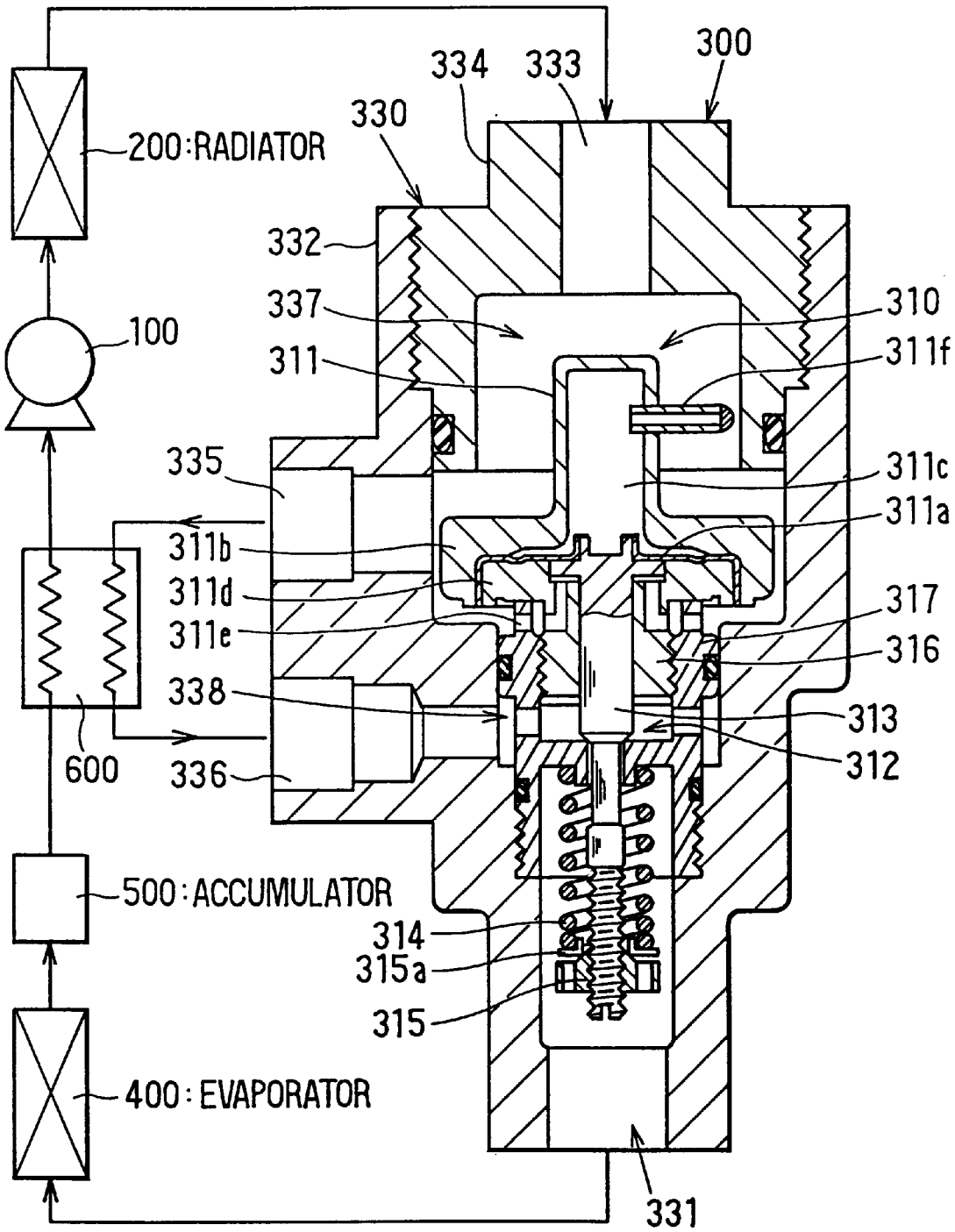
FIG. 1 is a sectional view of a pressure control valve according to a first embodiment of the present invention.

In this embodiment, a pressure control valve according to the present invention is applied to a refrigeration cycle in which carbon dioxide ($CO_2$) is used as a refrigerant (hereafter, referred to as $CO_2$ cycle), and FIG. 1 is a schematic illustration of the $CO_2$ cycle.

In FIG. 1, a compressor 100 compresses the refrigerant ($CO_2$), and a radiator (gas cooler) 200 cools the refrigerant compressed by the compressor 100. And, at an outlet side of the radiator 200, there is provided a pressure control valve 300 for controlling an outlet side pressure of the radiator 200 based on a refrigerant temperature at an outlet side of the radiator 200, and the pressure control valve body 300 also functions as a pressure reducing device for reducing pressure of the high pressure refrigerant. Incidentally, details of the pressure control valve 300 will be described later.

An evaporator 400 evaporates the (liquid phase) refrigerant whose pressure has been reduced by the pressure control valve 300. An accumulator (gas/liquid separation means) 500 separates the refrigerant flowing out from the evaporator 400 into a gas phase refrigerant and a liquid phase refrigerant, thereby causing the gas phase refrigerant to flow to a suction side of the compressor 100, and for storing an excessive refrigerant in the $CO_2$ cycle.

Figure 2:
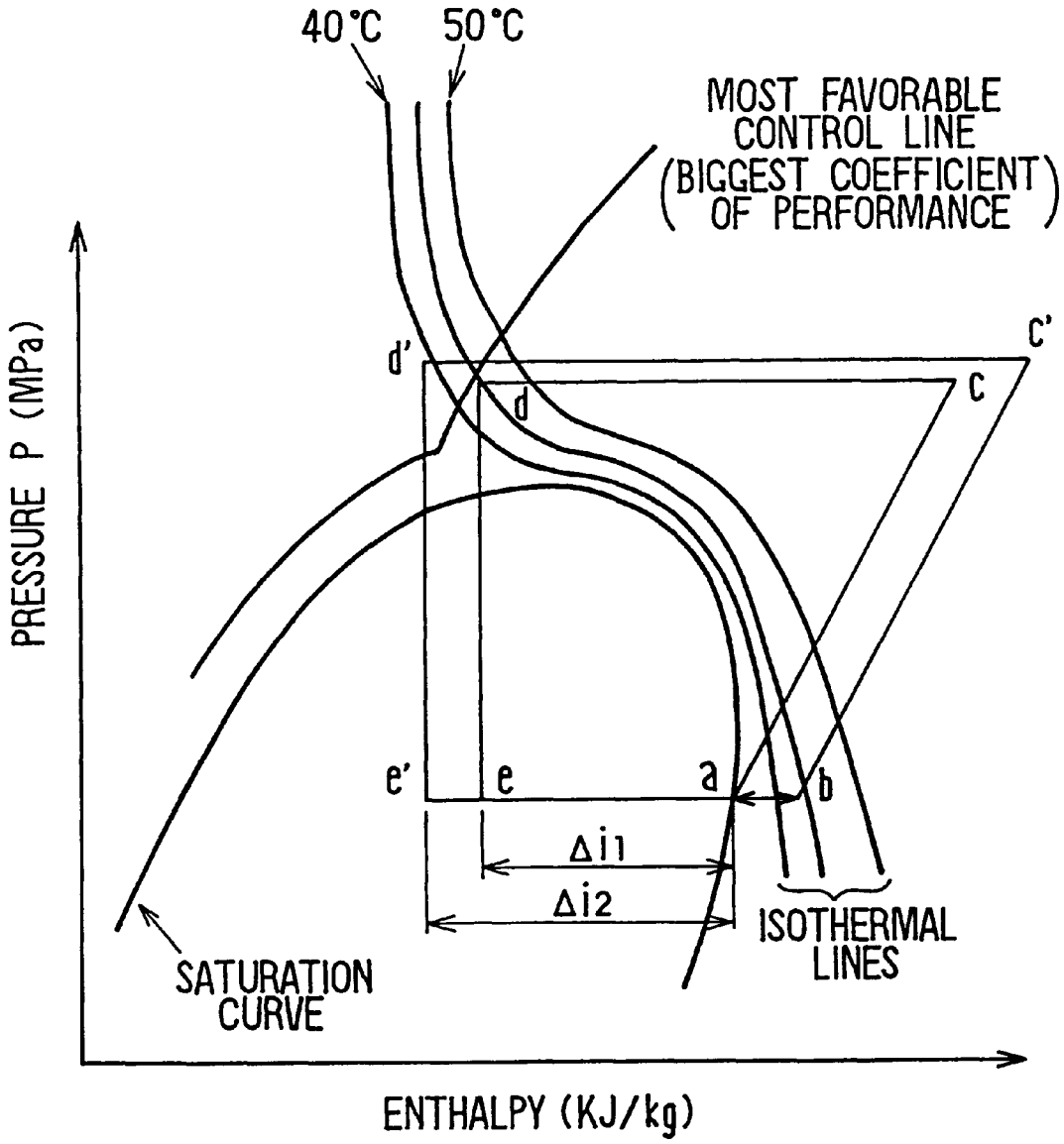
FIG. 2 is Mollier diagram of carbon dioxide according to a first embodiment of the present invention.

An internal heat exchanger (hereafter, abbreviated as heat exchanger) 600 executes heat exchange between the refrigerant at an outlet side of the evaporator 400 flowed out from the accumulator 500 and the refrigerant at the outlet side of the radiator 200. Enthalpy of the refrigerant at an inlet side of the evaporator 400 is lowered by the heat exchanger 600, and a refrigeration performance of the $CO_2$ cycle is improved as shown in FIG. 2.

Next, the pressure control valve 300 will now be explained based on FIG. 1.

A control valve main body (element) 310 has a temperature sensing portion 311 whose internal pressure changes according to refrigerant temperature at the outlet side of the radiator 200, and adjusts an opening degree of an valve port 312 of the pressure control valve 300 by mechanically interlocking with a change in the internal pressure of the temperature sensing portion 311. A casing 330 accommodates the control valve main body 310.

Incidentally, the casing 330 is composed of a casing main body portion 332 to which the control valve main body 310 is fixed and in which a first refrigerant outlet 331 connected to the inlet side of the evaporator 400 is formed, and of a lid body 334 which closes an opening part for inserting/incorporating the control valve main body 310 to the casing main body portion 332 and in which a first refrigerant inlet 333 connected to the outlet side of the radiator 200 is formed.

And, in the casing 330 (casing main body portion 332), there are formed a second refrigerant outlet 335 connected to a refrigerant inlet side of the heat exchanger 600 and a second refrigerant inlet 336 connected to a refrigerant outlet side of the heat exchanger 600. And, the second refrigerant outlet 335 communicates with the first refrigerant inlet 333, and the second refrigerant inlet 336 communicates with an upstream side of the valve port 312 of the control valve main body 310 in a refrigerant flow.

Incidentally, hereafter, a refrigerant passage extending from the first refrigerant inlet 333 to the second refrigerant outlet 335 is referred to as a first refrigerant passage (temperature sensing chamber) 337, and a refrigerant passage extending from the second refrigerant inlet 336 to the valve port 312 is referred to as a second refrigerant passage 338.

By the way, the temperature sensing portion 311 of the control valve main body 310 is positioned in the first refrigerant passage 337 and senses a refrigerant temperature at the outlet side of the radiator 200. The temperature sensing portion 311 comprises a film-like diaphragm (pressure responsive member) 331*a*, a diaphragm cover 311*b* for forming a sealed space (control chamber) 311*c* together with the diaphragm 311*a*, and a diaphragm support member 311*d* for fixing the diaphragm 311*a* so as to interpose the diaphragm 311*a* together with the diaphragm cover 311*b*.

Incidentally, in the sealed space 311*c*, the refrigerant ($CO_2$) is filled and sealed under a density (in this embodiment, about 625 kg/m$^3$) in the range from a saturated liquid density at its temperature of 0° C. of the refrigerant to a saturated liquid density at its critical point of the refrigerant. Pressure in the first refrigerant passage 337 is introduced via a pressure introduction passage 311*e* to an opposite side to the sealed space 311*c* with respect to the diaphragm 311*a*.

Further, 311*f* is a filling pipe for enclosing the refrigerant into the temperature sensing portion 311 (sealed space 311*c*). The filling pipe 311*f* is made of a metal having high thermal conductivity, such as copper or the like, in order to match the refrigerant temperature in the sealed space 311*c* to that in the first refrigerant passage 337 without time lag.

A needle valve body 313 (hereafter, abbreviated as valve body) adjusts an opening degree of the valve port 312. The valve body 313 is connected to the diaphragm 311*a* to move in a direction in which the opening degree of the valve port 312 is reduced mechanically interlocking with an internal pressure rise in the sealed space 311*c*.

A spring 314 (elastic body) applies an elastic force to the valve body 313 in the direction along which the opening degree of the valve port 312 is reduced. The valve body 313 is movable responding to a balance between the elastic force of the spring 314 (hereafter, this elastic force is referred to as valve closing force) and a force owing to a differential pressure between inside and outside of the sealed space 311*c* (hereafter, this force is referred to as valve opening force).

An initial set load for the spring 314 is adjusted by rotating an adjusting nut 315. The initial set load (elastic force under a state that the valve port 312 has been closed) is set such that the refrigerant has a predetermined supercooling degree (in this embodiment, about 10° C.) in a condensation region lower than the critical pressure. Concretely, it is about 1 [MPa] calculated in terms of pressure in the sealed space 311*c* at the initial set load. Incidentally, a spring washer 315*a* prevents the spring 314 from directly contacting the adjusting nut 315 when the adjusting nut 315 is rotated.

According to the above described structures, the pressure control valve 300 controls, in a supercritical region, a refrigerant pressure at the outlet side of the radiator 200 based on a refrigerant temperature at the outlet side of the radiator 200 so as to comply with an isopycnic line of 625 $Kg/m^3$, and controls, in a condensation region, a refrigerant pressure (opening degree of the pressure control valve 300) at the outlet side of the radiator 200 such that a supercooling degree of the refrigerant at the outlet side of the radiator 200 becomes a predetermined value valve.

A valve seat main body 317 of the control valve main body 310 and a valve body holder 316 described later separate the first refrigerant passage 337 from the second refrigerant passage 338, and further constitute a partition wall portion for preventing the refrigerant at a side of the refrigerant passage 338 from being heated by the refrigerant at a side of the first refrigerant passage 337.

Incidentally, since the valve body 313 extends from side of the first refrigerant passage 337 to the side of the second refrigerant passage 338 (valve port 312) penetrating through the valve body holder 316 for guiding a sliding movement of the valve body 313, a clearance (pressure loss) between the valve body 313 and the valve body holder 316 must be limited to such a degree that a large amount of refrigerant does not flow into the second refrigerant passage 338 from the first refrigerant passage 337 via this clearance.

Next, characteristics of this embodiment will now be described.

In the pressure control valve 300 according to this embodiment, since the temperature sensing portion 311 is located in the first refrigerant passage (temperature sensing chamber) 337, it is possible to reduce a timelag of temperature change in the sealed space (control chamber) 311*c* with respect to a refrigerant temperature change at the outlet side of the radiator 200 in comparison with means for sensing a refrigerant temperature at the outlet side of the radiator 200 by, as recited in Japanese Patent Application Laid-Open No. Hei 5-203291, making the temperature sensing portion into a temperature sensing cylinder using a capillary tube.

Therefore, since the temperature response characteristic of the pressure control valve 300 is improved, it is possible to suitably control the $CO_2$ cycle.

Further, in the sealed space 311*c*, since the refrigerant ($CO_2$) is enclosed under a density (in this embodiment, about 625 $Kg/m^3$) in the range from a saturated liquid density at its temperature of 0° C. to a saturated liquid density at its critical point, it is possible to improve the refrigeration performance of the $CO_2$ cycle while keeping a coefficient of performance of the $CO_2$ cycle high similarly to a pressure control valve for which an application (Japanese Patent Application No. Hei 9-315621) has been already filed by the applicant.

Further, since it is not necessary to assemble the capillary tube and the temperature sensing cylinder to the outlet side of the radiator as recited in Japanese Patent Application Laid-Open No. Hei 5-203291, it is possible to reduce the number of processes for assembling the $CO_2$ cycle (the number of manufacturing processes), so that it is possible to reduce a manufacturing prime cost of the $CO_2$ cycle.

(Second Embodiment)

In the first embodiment, since the control valve main body 310 (valve seat main body 317) is screw-fixed to the casing main body 332 in which the second refrigerant outlet 335 and the second refrigerant inlet 336 are formed, it is necessary to rotate the control valve main body 310 with respect to the casing main body 332 under a state that the control valve main body 310 is inserted into the casing main body 332, so that a workability for assembling the control valve main body 310 to the casing main body 332 may be bad.

Figure 3:
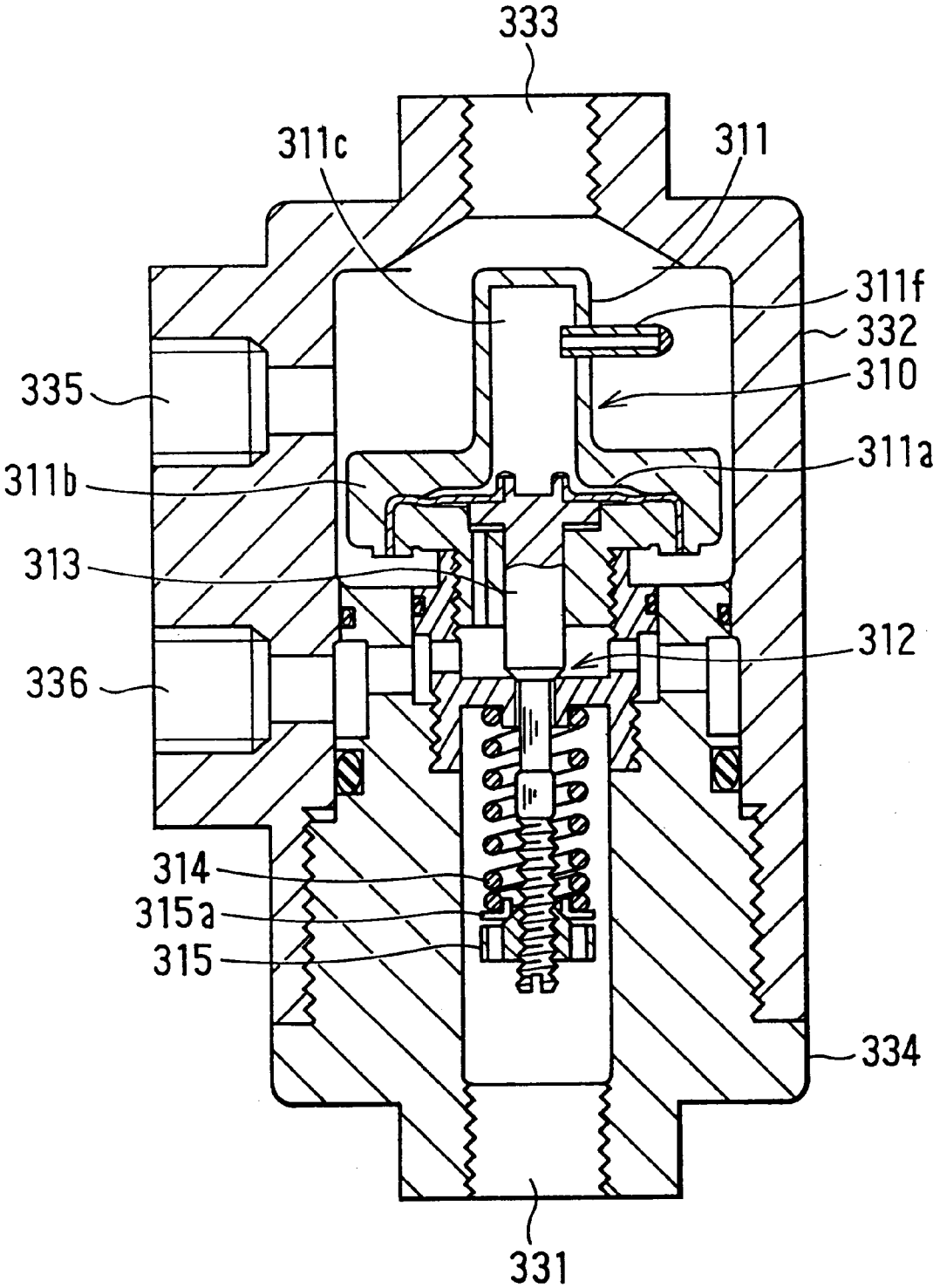
FIG. 3 is a sectional view of a pressure control valve according to a second embodiment of the present invention.

According to this embodiment, as shown in FIG. 3, there is adopted a structure in which the control valve main body 310 is screw-fixed to the lid body 334 for closing the casing main body 332, and the lid body 334 to which the control valve main body 310 has been fixed is screw-fixed to the casing main body 332. Incidentally, in this embodiment, the first refrigerant inlet 333 is formed in the casing main body 332, and the first refrigerant outlet 331 is formed in the lid body 334.

Accordingly, since it is not necessary to rotate the control valve main body 310 under the state that the control valve main body 310 is inserted into the casing main body 332 as described in the first embodiment, the workability for assembling the control valve main body 310 is improved.

Therefore, since the workability for assembling the pressure control valve 300 is improved, it is possible to attempt to reduce a manufacturing prime cost of the pressure control valve 300.

In the first embodiment, a pressure in the first refrigerant passage 337 is introduced to an opposite side to the sealed space (control chamber) 311*c* with respect to the diaphragm 311*a*. However, in case that a pressure loss at the heat exchanger 600 is sufficiently small, it may be constituted in such a manner that, as shown in FIG. 3, a pressure in the second refrigerant passage 338 is introduced to an opposite side to the sealed space (control chamber) 311*c* with respect to the diaphragm 311*a*.

(Third Embodiment)

Figure 4:
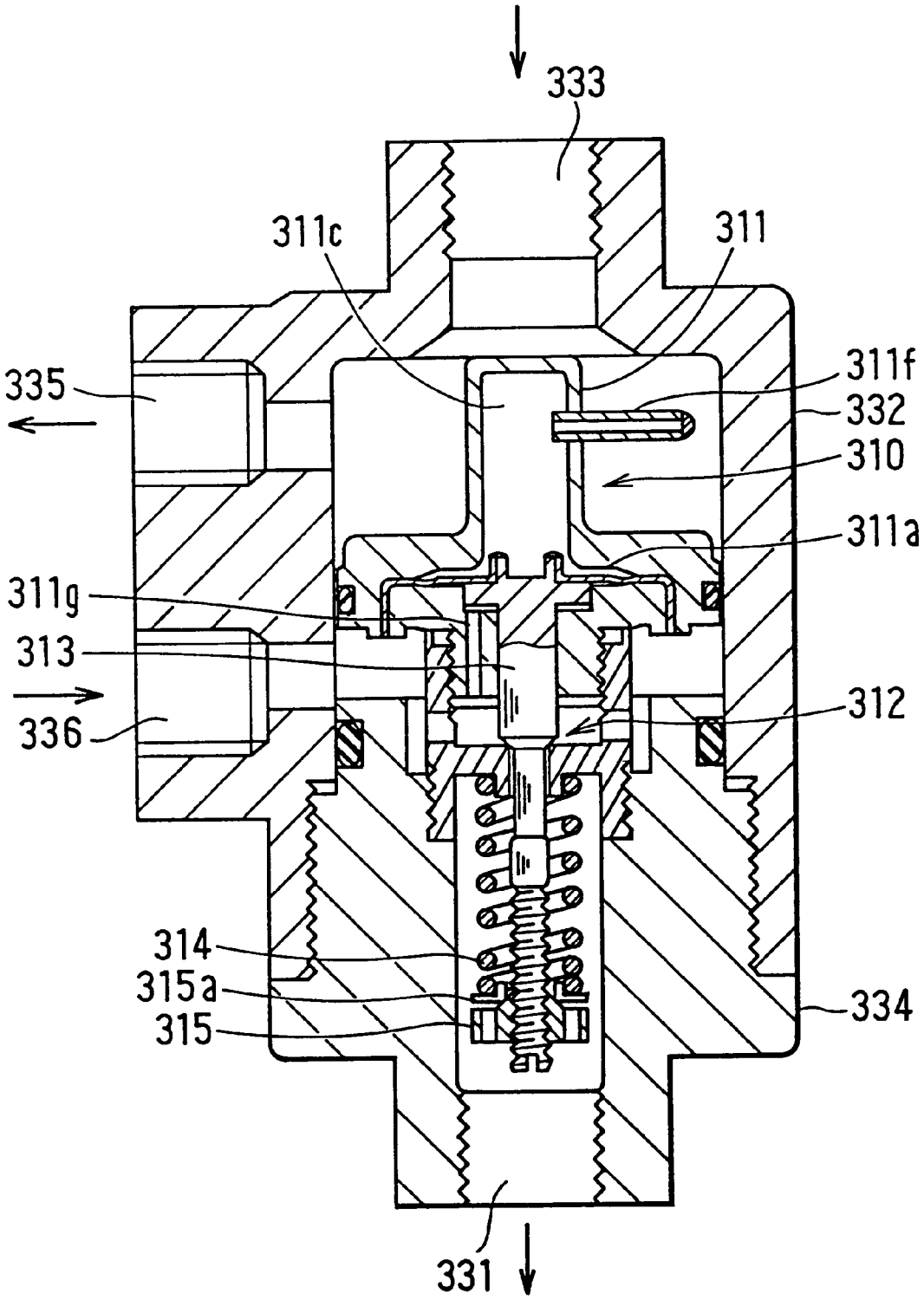
FIG. 4 is a sectional view of a pressure control valve according to a third embodiment of the present invention.

As shown in FIG. 4, the partition wall portion between the first refrigerant passage 337 and the second refrigerant passage 338 may be an outer peripheral part of the diaphragm cover 311*b*.

Incidentally, in this case, since the refrigerant in the second refrigerant passage 338 is cooled by the heat exchanger 600, a temperature in the sealed space (control chamber) 311 *c* 331*c* becomes lower than a refrigerant temperature at the outlet side of the radiator 200, so that it is necessary to make an initial set load of the spring 314 larger than that in the above-mentioned embodiments. By way of parenthesis, an increased amount of the initial load is 0.2–0.5 [MPa] calculated in terms of pressure in the sealed space 311*c*, although it differs depending on the capacity of the heat exchanger 600.

(Fourth Embodiment)

In the third embodiment, since a refrigerant which has passed through the first refrigerant passage 337 and has been cooled by the heat exchanger 600 (hereafter, this refrigerant is referred as low temperature refrigerant) flows being directed from the second refrigerant inlet 336 to the valve port 312, the internal temperature in the sealed space (control chamber) 311*c* becomes, owing to the low temperature refrigerant, lower than a refrigerant temperature at the outlet side of the radiator 200, so that there is a possibility that it becomes impossible to accurately control a refrigerant pressure at the outlet side of the radiator 200 (hereafter, this phenomenon is referred to as defective control owing to the low temperature refrigerant).

For this, although the defective control owing tithe low temperature refrigerant is corrected by adjusting the initial load of the spring 314 in the above-mentioned embodiments, an object of this embodiment is to control more accurately the refrigerant pressure at the outlet side of the radiator 200 by reducing the defective control owing to the low temperature refrigerant.

Figure 5:
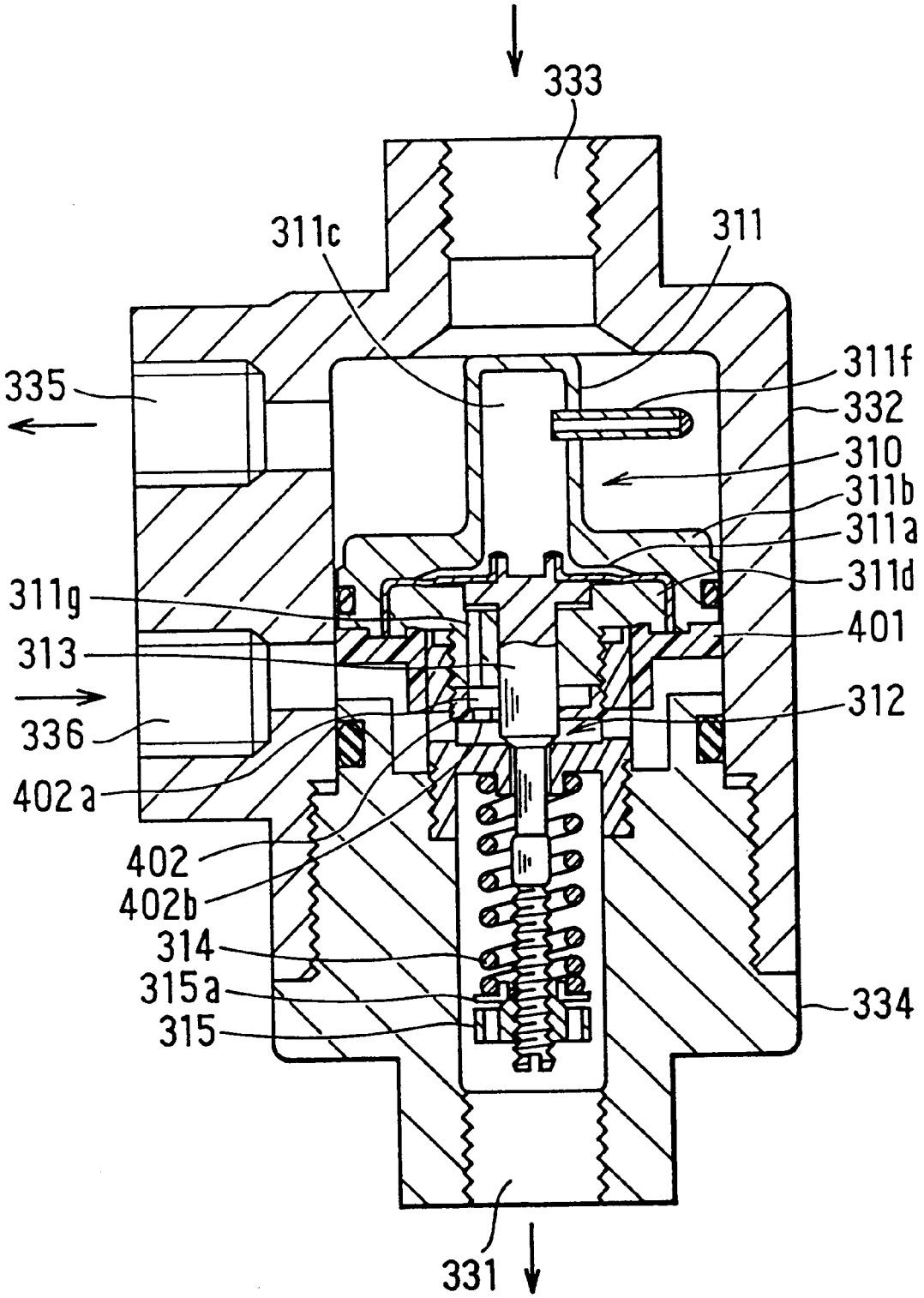
FIG. 5 is a sectional view of a pressure control valve according to a fourth embodiment of the present invention.

That is, as shown in FIG. 5, in order to prevent a heat transfer from the temperature sensing portion 311 to the second refrigerant passage 338 side, heat insulating covers 401, 402 made of a material having low thermal conductivity, such as resin, rubber or the like, are fixed to the diaphragm cover 311*b* and the second refrigerant passage 338 side of the diaphragm support 311*d* by an adhesive respectively.

Accordingly, since it is possible to prevent a temperature in the sealed space (control chamber) 311*c* from becoming, owing to the low temperature refrigerant, lower than a refrigerant temperature at the outlet side of the radiator 200, it is possible to control more accurately the refrigerant pressure at the outlet side of the radiator 200.

Incidentally, a concave portion 402*a* is formed at its diaphragm support 311*d* side of the heat insulating cover 402, and a communication hole 402*b* is formed in a bottom part of the concave portion 402*a*, in order to prevent a choke at a pressure introduction port 311*g* for introducing a pressure of the low temperature refrigerant to the valve body 313 side of the diaphragm 311*a*.

(Fifth Embodiment)

An object of this embodiment is to suppress the defective control owing to the low temperature refrigerant similarly to the fourth embodiment.

Figure 6:
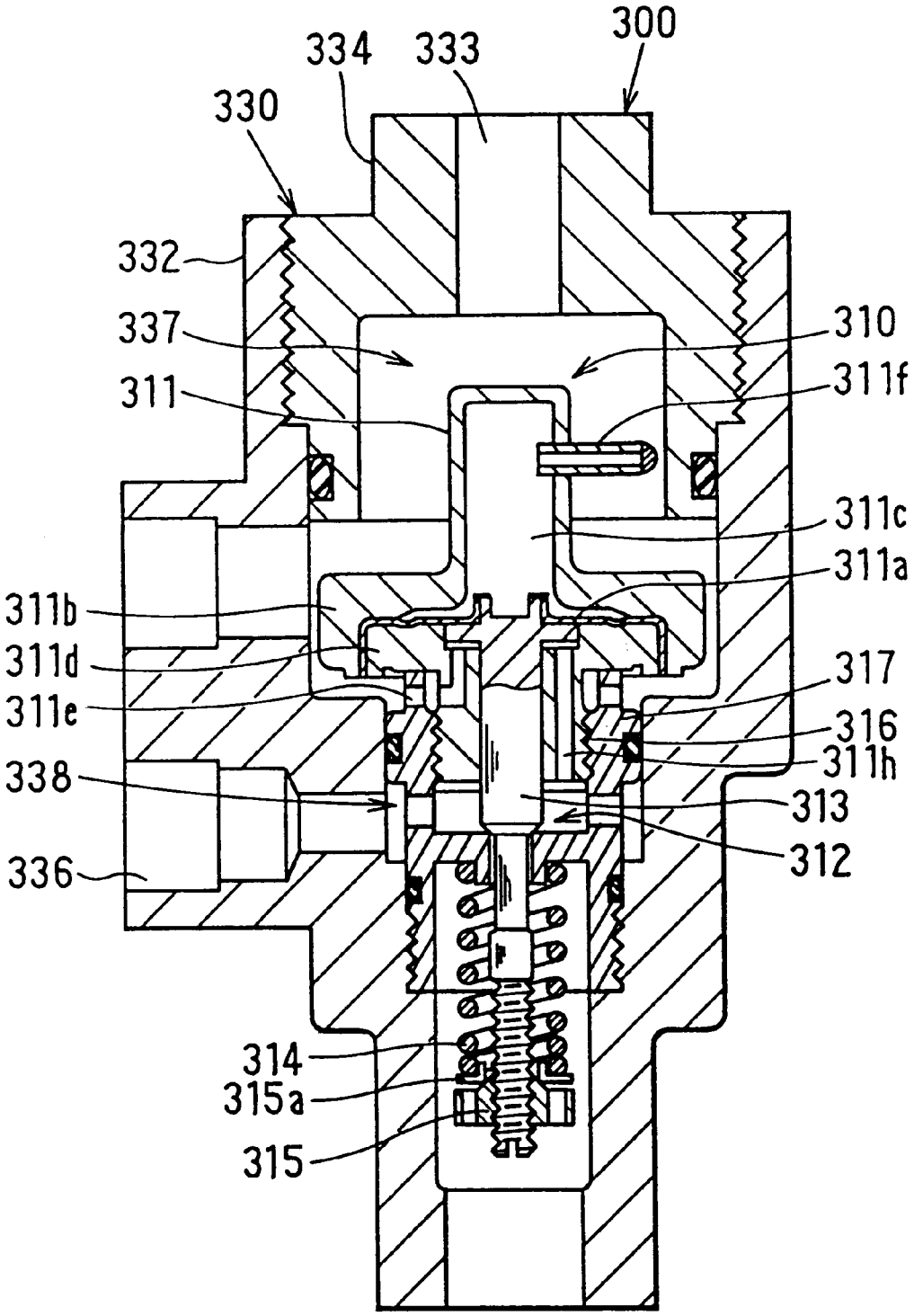
FIG. 6 is a sectional view of a pressure control valve according to a fifth embodiment of the present invention.
Figure 7:
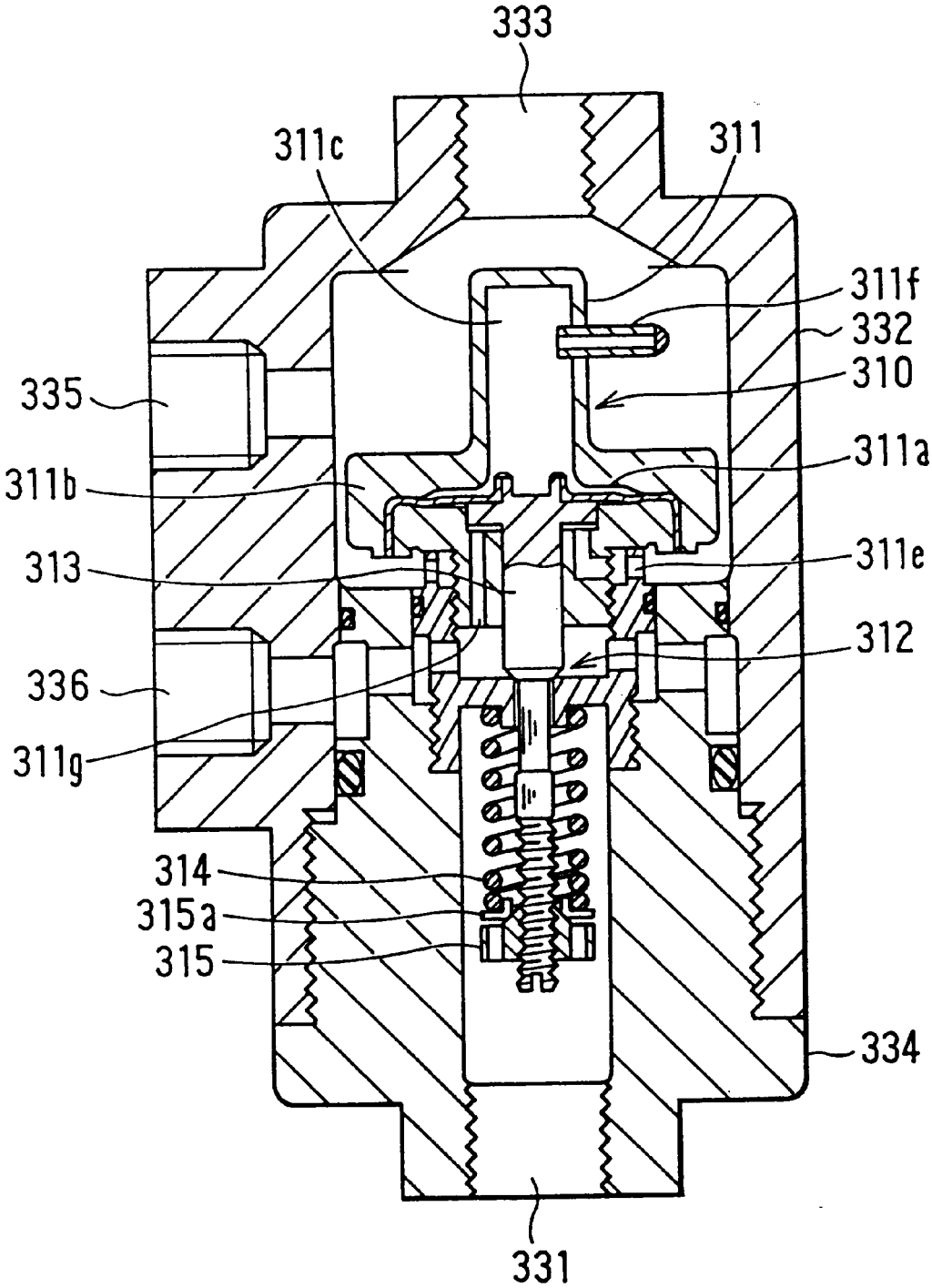
FIG. 7 is a sectional view showing a modified example of the pressure control valve according to the fifth embodiment.

That is, as shown in FIGS. 6 and 7, in this embodiment a temperature in the sealed space (control chamber) 311*c* is prevented from becoming lower than a refrigerant temperature at the outlet side of the radiator 200 by positively causing a high temperature-high pressure refrigerant (refrigerant flowing from the first refrigerant inlet 333 into the pressure control valve 300) to flow through the second refrigerant passage 338 side of the diaphragm 311*a* 331*a*.

Incidentally, in the pressure control valve 300 shown in FIG. 6, it is so adapted that the high temperature-high pressure refrigerant is positively caused to flow through the second refrigerant passage 338 side of the diaphragm 311*a* by providing the pressure control valve 300 according to the first embodiment (refer to FIG. 1) with a pressure introduction passage 311*h* for communicating the second refrigerant passage 338 (valve port 312) side with the second refrigerant passage 338 side of the diaphragm 311*a*.

In the pressure control valve 300 shown in FIG. 7, it is so adapted that the high temperature-high pressure refrigerant is positively caused to flow through the second refrigerant passage 338 side of the diaphragm 311*a* by providing the pressure control valve 300 according to the third embodiment (refer to FIG. 4) with a pressure introduction passage 311*e*.

By the way, if the high temperature-high pressure refrigerant is positively caused to flow through the second refrigerant passage 338 side of the diaphragm 311*a*, an amount of the refrigerant flowing through the heat exchanger 600 is reduced, so that the refrigeration performance of the $CO_2$ cycle may be compromised.

According to tests and studies conducted by the inventors, however, it has been confirmed that the lowering of the refrigeration performance can be practically neglected if a pressure loss when the high temperature-high pressure refrigerant flows through the second refrigerant 338 side is made larger than about twenty times that when the refrigerant flows through the heat exchanger 600.

In the above-mentioned embodiments, the pressure control valve according to the present invention has been applied to the pressure control valve 300 for the refrigeration cycle in which carbon dioxide is used as the refrigerant. However, the pressure control valve according to the present invention can be applied, of course, to a refrigeration cycle (supercritical refrigeration cycle) in which, for example, ethylene, ethane, nitrogen oxide or the like is used as the refrigerant and a pressure in the radiator 200 exceeds a critical pressure of the refrigerant, and also to a refrigeration cycle in which flon or the like is used as the refrigerant and a pressure in the radiator 200 is lower than a critical pressure of the refrigerant.

Furthermore, in the above-mentioned embodiments, the film-like diaphragm 311*a* is used as a pressure responsive member. However, the pressure responsive member may be composed of another one such as accordion-like bellows or the like.

Although the present invention has been described in connection with the preferred embodiments thereof with reference to the accompanying drawings, it is to be noted that various changes and modifications will be apparent to those skilled in the art. Such changes and modifications are to be understood as being included within the scope of the present invention as defined in the appended claims.

What is claimed is:

1. A pressure control valve for a vapor compression type refrigeration cycle having a radiator for radiating heat of compressed refrigerant, an evaporator for evaporating refrigerant and a heat exchanger for performing heat exchange between the refrigerant at an outlet side of said evaporator and the refrigerant at an outlet side of said radiator, said pressure control valve being located between the outlet side of said radiator and an inlet side of said evaporator, said pressure control valve comprising:

a temperature sensing portion for changing its internal pressure according to a refrigerant temperature at the outlet side of said radiator;

a valve port for being controlled according to the refrigerant temperature at the outlet side of said radiator to control a refrigerant pressure at the outlet side of said radiator;

a control valve main body having said temperature sensing portion for adjusting an opening degree of said valve port by mechanically interlocking with said internal pressure change of said temperature sensing portion;

a casing for accommodating said control valve main body;

a temperature sensing chamber formed in said casing for accommodating said temperature sensing portion and for communicating with an inlet side of said heat exchanger; and a pressure introduction passage formed in said casing for introducing a refrigerant from said heat exchanger to an upstream side of said valve port in a refrigerant flowing direction.

2. A pressure control valve according to claim 1, wherein the pressure control valve includes a heat insulating member for preventing a heat transfer between said temperature sensing portion and said pressure introduction passage.

3. A pressure control valve according to claim 1, wherein the pressure control valve includes a second pressure introduction passage for allowing a part of refrigerant in said temperature sensing chamber to flow to said pressure introduction passage.

4. A pressure control valve for a vapor compression type refrigeration cycle having a radiator for radiating heat of compressed refrigerant, an evaporator for evaporating refrigerant and a heat exchanger for performing heat exchange between the refrigerant at an outlet side of said evaporator and the refrigerant at an outlet side of said radiator, said pressure control valve being located between the outlet side of said radiator and an inlet side of said evaporator, said pressure control valve comprising:

a valve port for being controlled according to the refrigerant temperature at the outlet side of said radiator to control a refrigerant pressure at the outlet side of said radiator;

a casing having a first refrigerant passage, a second refrigerant passage and a separation portion, said first refrigerant passage being for making a communication between the outlet side of said radiator and an inlet side of said heat exchanger, said second refrigerant passage being for introducing a refrigerant from said heat exchanger to an upstream side of said valve port in a refrigerant flowing direction, said separation portion being for separating said first refrigerant passage and said second refrigerant passage;

a temperature sensing portion for changing its internal pressure according to a refrigerant temperature in said first refrigerant passage; and a valve body penetrating through said separation portion for controlling an opening degree of said valve port by mechanically interlocking with the internal pressure change of said temperature sensing portion.

5. A pressure control valve according to claim 4, wherein the pressure control valve includes a heat insulating member for preventing a heat transfer between said temperature sensing portion and said second refrigerant passage.

6. A pressure control valve according to claim 4, wherein the pressure control valve includes a pressure introduction passage for allowing a part of refrigerant flowing through said first refrigerant passage to flow to said second refrigerant passage.

* * * * *